US010857417B2

(12) United States Patent
Jagessar

(10) Patent No.: US 10,857,417 B2
(45) Date of Patent: Dec. 8, 2020

(54) THERAPEUTIC EXERCISE CONTOUR SUPPORT

(71) Applicant: Miguel Jagessar, Couva (TT)

(72) Inventor: Miguel Jagessar, Couva (TT)

(73) Assignee: Miguel Jagessar

( * ) Notice: Subject to any disclaimer, the term of this patent is extended or adjusted under 35 U.S.C. 154(b) by 162 days.

(21) Appl. No.: 15/907,400

(22) Filed: Feb. 28, 2018

(65) Prior Publication Data

US 2019/0262659 A1 Aug. 29, 2019

(51) Int. Cl.

| | |
|---|---|
| ***A63B 23/02*** | (2006.01) |
| ***A63B 21/00*** | (2006.01) |
| ***A47G 9/10*** | (2006.01) |

(52) U.S. Cl.

CPC ..... *A63B 21/4039* (2015.10); *A47G 9/1081* (2013.01); *A47G 2009/1018* (2013.01)

(58) Field of Classification Search

CPC ..... A61H 2205/081; A63B 21/4039; A63B 21/4029; A47G 2009/1018

See application file for complete search history.

(56) References Cited

U.S. PATENT DOCUMENTS 1,549,601 A * 8/1925 Mulgrew ..... A47C 7/40 5/632
4,230,099 A * 10/1980 Richardson ..... A61F 5/01 606/240
4,474,370 A * 10/1984 Oman ..... A63B 21/4029 482/104
4,621,809 A * 11/1986 Pearl ..... A63B 21/4029 482/104
4,876,755 A * 10/1989 Parrish ..... A47C 7/425 297/284.3
5,007,633 A * 4/1991 Lemire ..... A63B 21/078 482/142
5,447,481 A * 9/1995 Emter, Jr. ..... A63B 21/078 482/104
5,649,886 A * 7/1997 Danylieko ..... A63B 21/078 482/104
7,153,249 B2 * 12/2006 O'Connor ..... A63B 21/078 482/142
7,445,008 B1 * 11/2008 Walker ..... A47C 7/021 128/845

(Continued)

*Primary Examiner* — Joshua T Kennedy

(74) *Attorney, Agent, or Firm* — Ingerium Patents LLC; Peter R Kramer

(57) ABSTRACT

The therapeutic exercise contour support (TECS), made of high density flexible foam, which can either be used on traditional bench press equipment or as a stand-alone apparatus. The TECS provides support for the neck, upper body and lower back when performing bench press exercise. The TECS has a distinctive contoured surface that elevates the spine and allows the user to have a natural scapula-humeral rhythm when performing the bench press at inclined, horizontal and declined inclinations. An adjustable ergonomic neck foam support can be attached to the main contour support to maintain proper cervical curvature. The TECS can also be used for therapy by placing it on a horizontal surface and then lying on it in a supine position. This helps the scapulae to retract as they should, which may assist in alleviating pain in the upper back due to poor posture and muscle imbalance.

2 Claims, 3 Drawing Sheets

ISOMETRIC VIEW

(56) References Cited

U.S. PATENT DOCUMENTS

| | | | | |
|---|---|---|---|---|
| 8,413,275 | B1 * | 4/2013 | Yates | A47C 16/005 5/632 |
| 9,174,081 | B2 * | 11/2015 | Cecil | A63B 23/02 |
| 9,504,870 | B2 * | 11/2016 | Strong Crawley | A63B 21/078 |
| 2008/0248936 | A1 * | 10/2008 | Ferriss | A61H 7/001 482/142 |
| 2011/0152035 | A1 * | 6/2011 | Wahl | A63B 21/4039 482/51 |
| 2015/0246259 | A1 * | 9/2015 | Stoesslein | A63B 21/4029 482/142 |
| 2019/0118028 | A1 * | 4/2019 | Mancias | A63B 21/4033 |

* cited by examiner

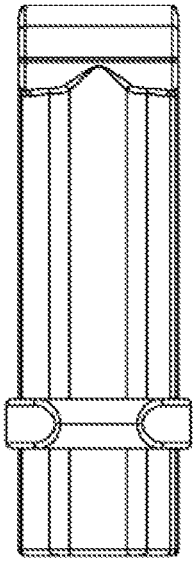
FIG 1A PLAN VIEW
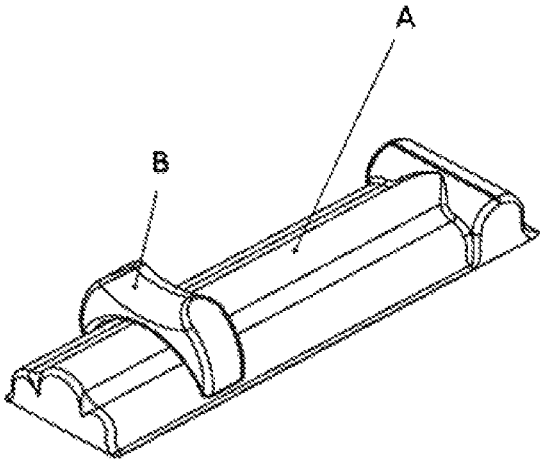
FIG 1D ISOMETRIC VIEW
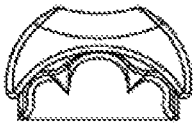
FIG 1B FRONT VIEW
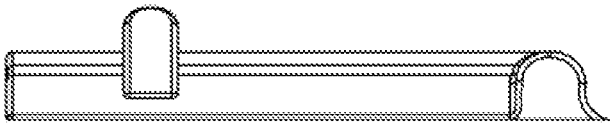
FIG 1C SIDE VIEW

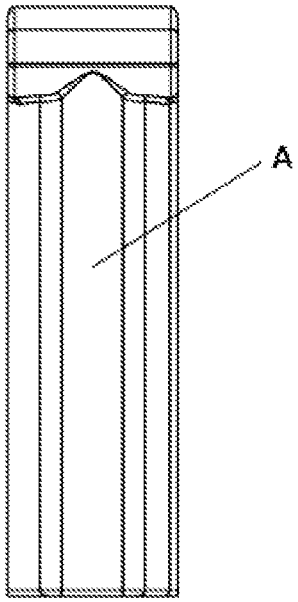
FIG 2A PLAN VIEW
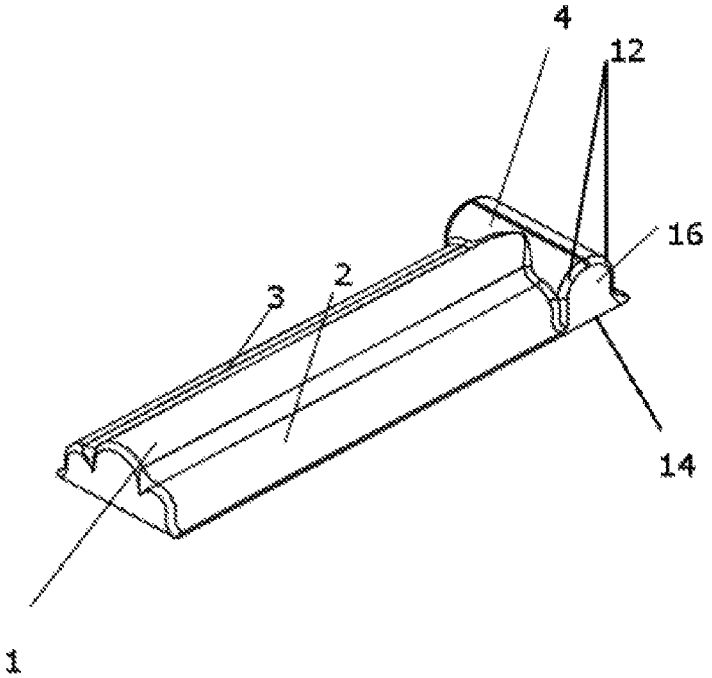
FIG 2D ISOMETRIC VIEW
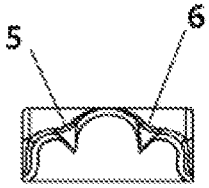
FIG 2B FRONT VIEW
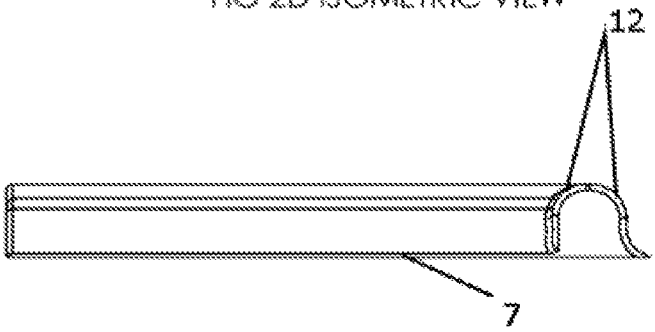
FIG 2C SIDE VIEW

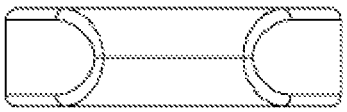
FIG 3A PLAN VIEW
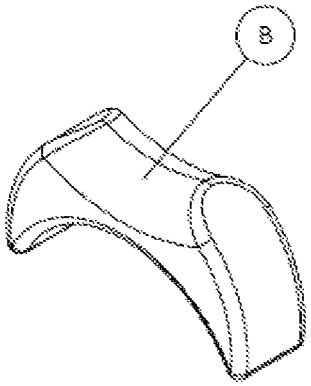
FIG 3D ISOMETRIC VIEW
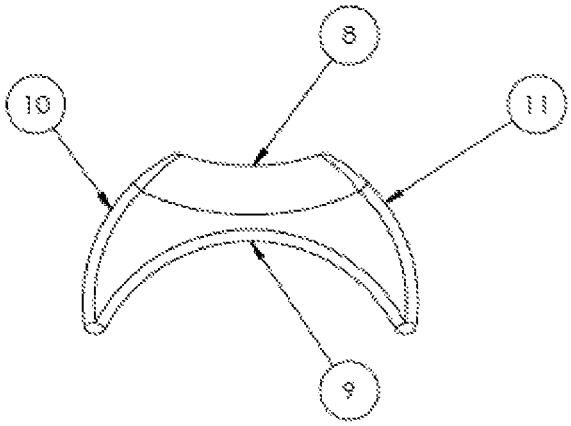
FIG 3B FRONT VIEW
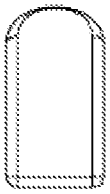
FIG 3C SIDE VIEW

THERAPEUTIC EXERCISE CONTOUR SUPPORT

SUMMARY OF INVENTION

The present invention relates to a distinctive ergonomic upper body contoured foam support surface and removable neck support which can be mounted to traditional bench press equipment for improving performance of the barbell/dumbbell bench press exercise as well as other upper-body exercises. The TECS can also be used for therapeutic purposes by lying supine on the contoured support.

BACKGROUND OF INVENTION

In our modern society, people are becoming more aware of the health benefits of weight training. Many go to commercial gyms to weight train. However, it is very difficult for many others to find time to workout at commercial gyms and therefore, they train at home. With a pair of dumbbells, many weight training exercises can be performed for training the muscles of the legs, back, shoulders and arms. Push-ups can be done for training the pectoral muscles, however, strength and hypertrophy soon stalls as the muscles adapt to the stimulus (load). It then becomes necessary to acquire a bench or elevated surface to perform weighted dumbbell bench presses/flys to increase the load for inducing muscle hypertrophy and upper body strength.

Of all free weight exercises, the dumbbell/barbell bench press, when performed on a flat bench surface, restricts scapulae movement and is a major cause of shoulder pain and injury. Most benches sold in residential and commercial markets are designed with a flat surface. Many users are unaware of the shoulder injuries that can be incurred when performing the bench press on such surface. Secondly, the lordotic curve of the lower-back and the cervical curve of the neck are not supported when performing the bench press on a flat bench surface.

Poor posture, weak rotator cuff muscles and over-powering muscles of the chest and shoulders can prevent the scapulae from proper articulation of the upper body. The inner border of the scapula flares out (scapula-winging) and can cause severe pain.

Lying supine on a contoured surface that elevates the spine and helps the scapulae to retract can aid in alleviating pain and restore range of motion.

DETAILED DESCRIPTION OF INVENTION

The upper body ergonomic contour foam support member A and the neck support member B fulfil several functions as illustrated in FIGS. 1*d* and 3*d*. The removable neck support member B depicted in FIG. 3*d* can be adjusted for varying heights of users. The curved surface (1) of member A, illustrated in FIG. 2*d* is approximately 100 mm in diameter and elevates the spine, thereby creating space between the contoured surfaces (5 and 6) and the scapula as illustrated in FIG. 2*b*. This produces natural scapula-humeral rhythm and allows the scapula to retract and protract naturally when the bench press is performed with either dumbbells or barbells. The middle portion of the contour support (1) by itself is too narrow and can introduce lateral instability when pressing. For this reason, convex surfaces (2 and 3), as illustrated in FIG. 2*d*, approximately 60 mm in diameter are contoured to surfaces (5) and (6) on both sides of member A. These smaller circular cross-sections are large enough to prevent lateral instability and small enough to not impede scapula-humeral rhythm. Surfaces (5) and (6) are appropriately sized to increase range of motion of the shoulder joint about the frontal plane, whilst preventing the user from toppling sideways with barbell/dumbbells in their hands. Thus, preventing serious injury from falling weights. Lower back support member (16) has a flat bottom (14) and a contoured surface (4) which is perpendicular to surface (1) with an approximate diameter of 100 mm, and provides lower-back support for the user. In addition, surface (7) is flat and allows member A to rest stationary on any horizontal surface. The specific shape of member A can be foam moulded and upholstered to improve aesthetics and longevity. The removable cervical neck support member B can be attached to member A using straps. The upper body contour support can then be strapped to any traditional bench press machine or be built into the bench surface thereby making the surface more suitable for bench pressing. It is light weight and can be easily carried around for any time of use.

When lying supine on a flat surface the head tilts backwards and increases the cervical curvature. In this tilted position the muscles of the neck are not relaxed. Cervical spinal discs and connective ligaments are put under undue strain. The removable neck support member B, when attached, has its top surface (8) elevated at approximately 85 mm above surface (1) of member A. The neck support member B maintains the cervical curvature of the neck, prevents lateral instability and can provide therapeutic comfort by relieving stress in the neck and trapezius muscles. With the neck supported, the user is able to focus on performing the bench press to effectively maximize recruitment of the pectoralis major muscle. Curved surface (9) of member B allows for ease of attachment to member A. Surfaces (10) and (11) improve the aesthetics of the neck support and enables less material to be used for manufacturing.

When the TECS is being used solely for therapeutic purposes, the upper body ergonomic contour support member A and cervical neck support member B can be placed on a bench or horizontal surface/floor. The user can then simply lie supine on the arranged contour support. This arrangement can assist in relieving undue stress in the shoulders, upper and lower back and neck.

BRIEF DESCRIPTION OF DRAWINGS

FIGS. 1*a*, 1*b*, 1*c*, and 1*d* illustrate the top, front, side and isometric views of the Therapeutic Exercise Contour Support.

FIGS. 2*a*, 2*b*, 2*c*, and 2*d* illustrate the top, front, side and isometric views of the upper body ergonomic contour support.

FIGS. 3*a*, 3*b*, 3*c*, and 3*d* illustrate the top, front, side and isometric views of the cervical neck support.

I claim:

1. An ergonomic upper body contour support member comprising:

a first semi-circular curved surface extending longitudinally to elevate a spine of a user, wherein the first curved surface comprises a diameter of about 100 mm;

two convex surfaces extending longitudinally along the first curved surface, wherein each convex surface extends on a different side of the contour support member, and wherein each of the two convex surfaces comprises a diameter of about 60 mm such that the convex surfaces extend laterally from said first curved surface a distance approximately equal to the diameters of the convex surfaces;

two contour surfaces, wherein each contour surface is formed on a different side of the contour support member between a respective convex surface and the first curved surface; and said ergonomic upper body contour support member having a lower back support member located at one end of the upper body contour support member, said lower back support member having a second contoured surface that extends perpendicular to the first curved surface to form a T configuration, said lower back support member being configured to provide lower-back support to the user, wherein said lower back support member having a flat bottom and further wherein said lower back support member having an arch shape, and yet further wherein the second contoured surface comprises a diameter of about 100 mm.

2. The ergonomic upper body contour support member of claim 1, further comprising a removable neck support member configured to be attached to the curved surface.

* * * * *